US006540173B1

(12) United States Patent
Mäki-Rahkola et al.

(10) Patent No.: US 6,540,173 B1
(45) Date of Patent: Apr. 1, 2003

(54) METHOD AND DEVICE FOR ROTATING ROLLS

(75) Inventors: Jari Mäki-Rahkola, Kauhajoki (FI); Jouko Metsä-Ranta, Kauhajoki (FI)

(73) Assignee: Pesmel Oy, Kauhajoki (FI)

( * ) Notice: Subject to any disclaimer, the term of this patent is extended or adjusted under 35 U.S.C. 154(b) by 0 days.

(21) Appl. No.: 09/807,037

(22) PCT Filed: Oct. 8, 1999

(86) PCT No.: PCT/FI99/00835

§ 371 (c)(1),
(2), (4) Date: Jul. 2, 2001

(87) PCT Pub. No.: WO00/21867

PCT Pub. Date: Apr. 20, 2000

(30) Foreign Application Priority Data

Oct. 9, 1998 (FI) ..... 982197

(51) Int. Cl.[7] ..... B65H 18/22

(52) U.S. Cl. ..... 242/541.3; 242/595.1; 53/211; 53/587

(58) Field of Search ..... 242/541.3, 594.1, 242/594.2, 595.1, 592; 53/399, 211, 588, 212, 389.5, 465, 587, 430, 118

(56) References Cited

U.S. PATENT DOCUMENTS

| | | | | |
|---|---|---|---|---|
| 2,057,191 A | * | 10/1936 | Huffine | 242/541.3 |
| 3,501,106 A | * | 3/1970 | Case | 242/541.3 |
| 3,743,205 A | * | 7/1973 | Misrach | 242/595.1 |
| 4,804,152 A | | 2/1989 | Masuda | |
| 5,054,263 A | | 10/1991 | Mäki-Rahkola et al. | |
| 5,086,610 A | | 2/1992 | Maki-Rahkola et al. | |
| 5,092,109 A | | 3/1992 | Maki-Rahkola et al. | |
| 5,139,207 A | * | 8/1992 | Meschi | 242/595.1 |
| 5,165,617 A | * | 11/1992 | van Vuuren | 242/541.3 |
| 5,326,041 A | | 7/1994 | Alexander, III et al. | |
| 5,478,027 A | | 12/1995 | Alexander, III | |
| 5,487,255 A | | 1/1996 | Söderberg | |
| 5,638,749 A | * | 6/1997 | Ansbjer et al. | 53/587 |

FOREIGN PATENT DOCUMENTS

| | | | | |
|---|---|---|---|---|
| CH | 591 381 | | 9/1977 | |
| DE | 1 081 095 | | 5/1960 | |
| DE | 4412997 | | 10/1995 | |
| GB | 2 245 887 A | | 1/1992 | |
| JP | 59012036 | | 1/1984 | |
| JP | 4-311420 | * | 4/1992 | 53/118 |

* cited by examiner

*Primary Examiner*—John M. Jillions
(74) *Attorney, Agent, or Firm*—Connolly Bove Lodge & Hutz LLP

(57) ABSTRACT

The invention relates to a method and device for rotating rotational bodies (1), such as rolls, along their longitudinal axis (X) by means of motion of a trough-like surface (2) guiding and supporting said body (1). In the invention, the axis of rotation of the body (1) moving on said surface is guided by means of the profile (2*a*, 7*a*, 7*b*) of the surface (2) to a new position to eliminate the swinging of the body (1). In an embodiment, said profile (2*a*, 7*a*, 7*b*) comprises a straight section (2*a*) and a section (7*a*, 7*b*) which is arranged at least on the other side of the same, and which comprises a surface that rises outwards. The diagonal surface can be arranged as a separately attachable part. By means of the invention, the swinging of the conical roll (1) is prevented during rotation.

14 Claims, 2 Drawing Sheets

METHOD AND DEVICE FOR ROTATING ROLLS

Figure 1:
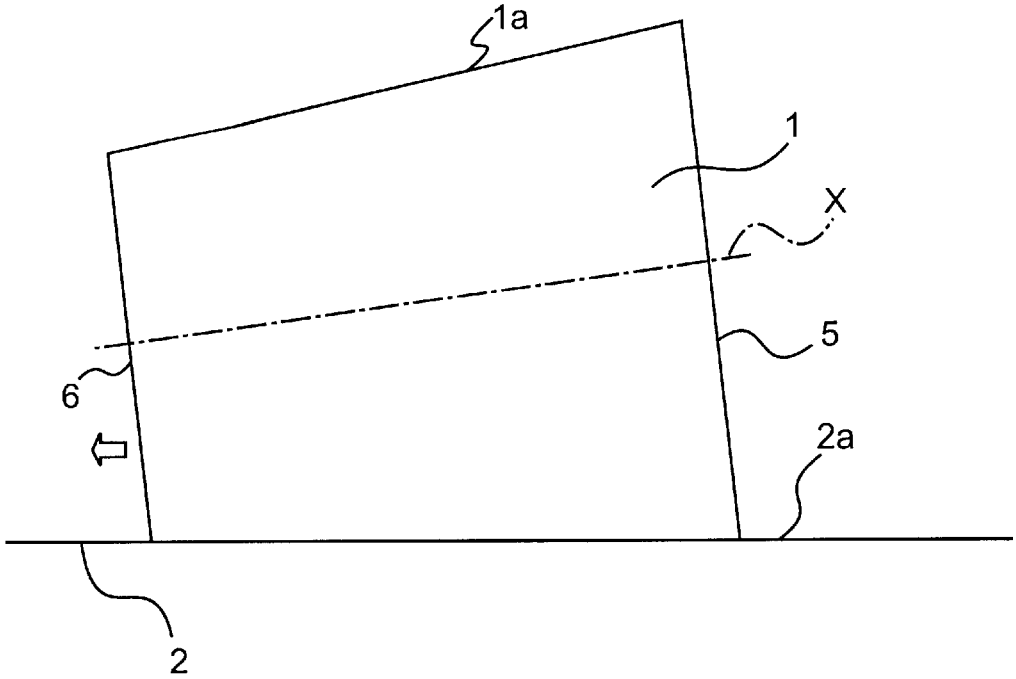
FIG. 1 PRIOR ART

The invention relates to a method for rotating rolls. The invention also relates to a device for rotating rolls. Furthermore, the invention relates to an arrangement for a rotating device.

As is well known, for wrapping of cylindrical pieces, such as paper rolls, wrapping devices known as such are used, which devices perform the wrapping by means of a wrapping film, typically a transparent stretch film or a thin plastic film. One known wrapping device is disclosed in the patent publication U.S. Pat. No. 5,086,610. The wrap is guided around the mantle of the piece and at the same time the piece is rotated around its central line i.e. its longitudinal axis. At the final stage of the wrapping, the film is cut, and the end of the film is welded on the other films by means of hot sealing. As to the techniques involved in cutting, sealing and feeding of the film, reference is made e.g. to the patent publication U.S. Pat. No. 5,092,109. During the wrapping the wrapping film is stretched in a controlled manner as presented for example in the patent publication U.S. Pat. No. 5,054,263. The wrap can be guided around the mantle and the ends of the piece in such a way that the piece is rotated both around the longitudinal axis and a typically vertical axis which is transverse to the longitudinal axis. An example of such a device is disclosed in the patent publication U.S. Pat. No. 5,487,255. Alternatively, the carriage feeding the wrap can rotate around an axis vertical with respect to the piece, wherein the piece is typically only rotated around its horizontal central line.

When rolls are manipulated, for example packed in a wrap or transferred to a new working station, they have to be rotated around their longitudinal axis. Although the rolls, such as paper rolls, are nominally cylindrical, the softness of the material in the roll, the directional errors in the wrapping, variations in humidity and other factors effect the actual shape to be conical. The conical shape results in that the presently used rotating devices deflect the direction of the longitudinal axis of the roll during the rotation. This, in turn, causes errors in other work stages, such as packing effected by means of wrapping.

The problem occurs especially in devices according to the patent publication U.S. Pat. No. 5,487,255, in which conical rolls are rotated in a recess formed in a continuous track. The track is formed around two reels which are rotated, and the aim is to rotate the roll around its longitudinal axis substantially in its position by means of the moving track.

Heretofore, attempts have been made to solve said problem with separate blocking rolls and wheels. These, however, cause dents on the roll which impair the quality of the roll, and they are also expensive and cumbersome.

It is an aim of the invention to eliminate this drawback and to attain a method and a device, in which, without impairing the quality of the roll, the axle of the roll does not tend to swing during rotation even though the roll has the shape of a cone. This eliminates the errors caused by the swinging in the manipulation of the rolls.

Said problem occurs especially in soft rolls. The best solution for rotating these rolls is a slat chain trough in which the roll is rotating.

According to the invention, the act of rotating the roll so that the roll does not swing can be attained by shaping the surface of the trough in such a way that the slope angle of the profile of the surface changes in the direction of the axis of the roll. The roll is positioned in such a location during the rotation that the axle of the roll is parallel to the axis of rotation, and thus, the roll does not tend to swing.

Figure 2:
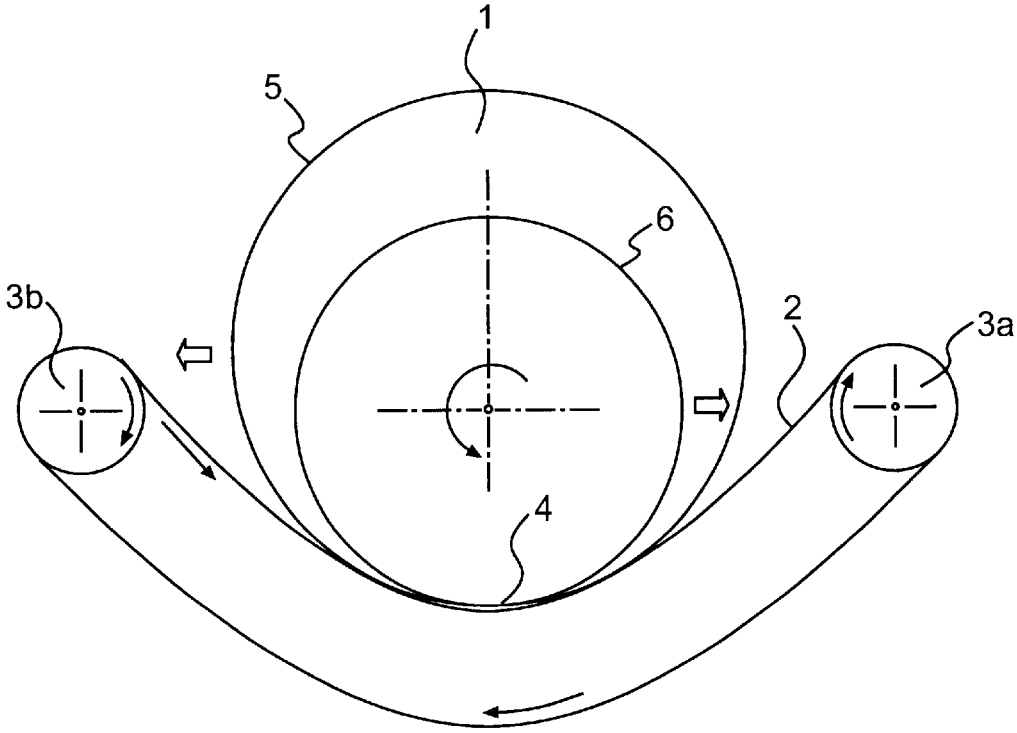
FIG. 2 PRIOR ART
Figure 3:
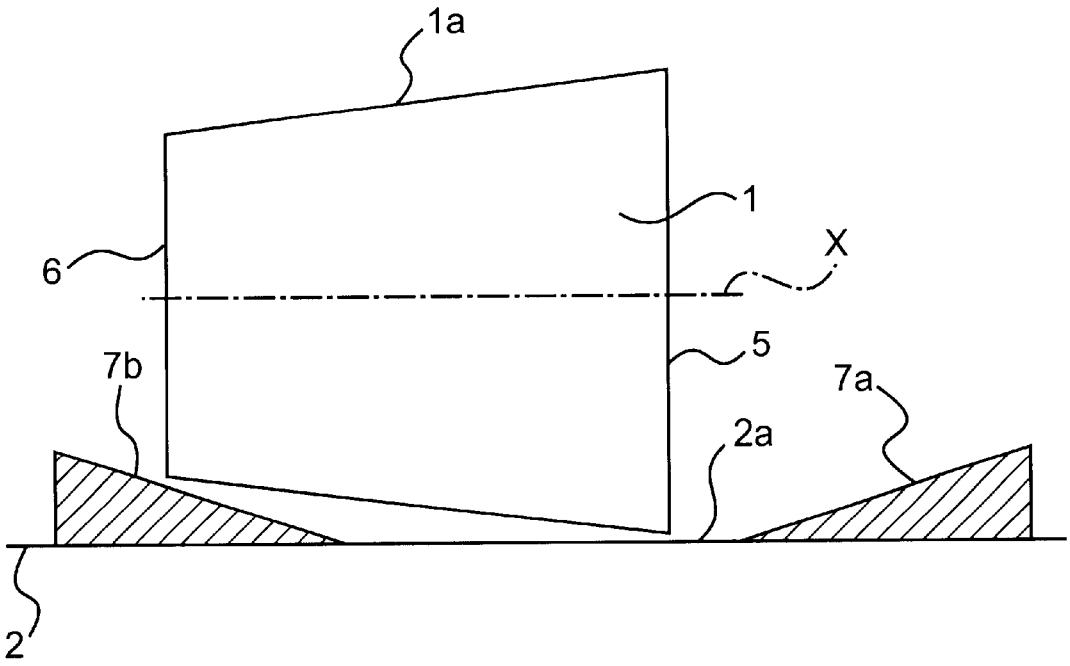
Figure 4:
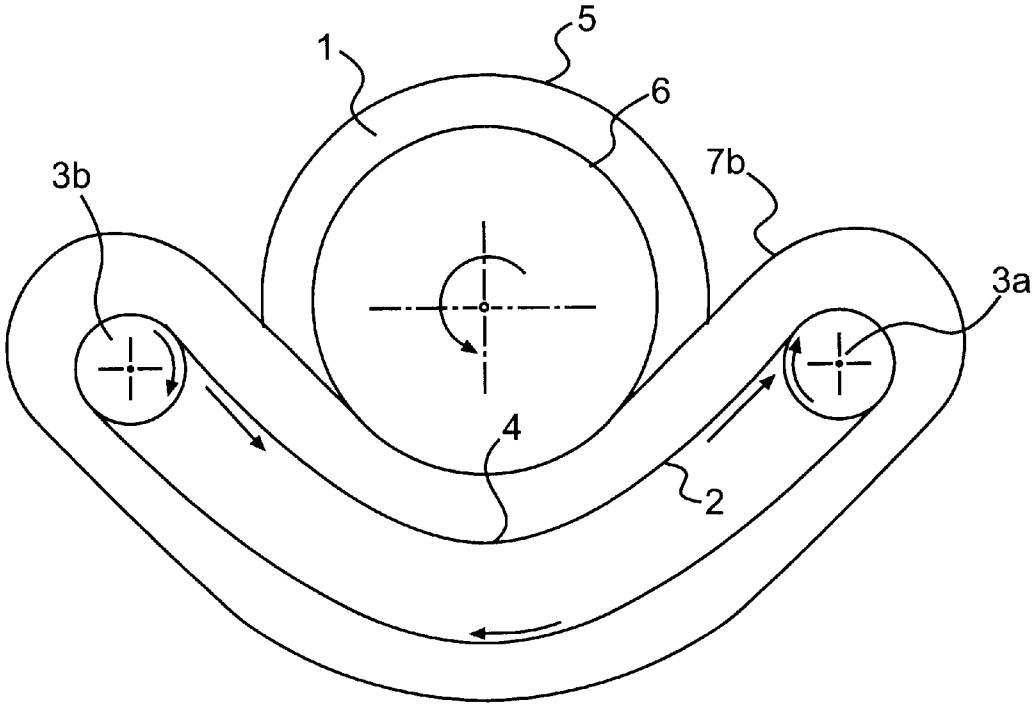

In the following, the invention will be described in more detail by means of a preferred embodiment and with reference to the appended drawings, in which FIG. 1 shows a side view of a prior art solution for rotating a roll, FIG. 2 shows a roll according to FIG. 1 seen from the direction of the smaller end, FIG. 3 shows a side-view of a preferred embodiment of the invention, and FIG. 4 shows the roll according to FIG. 3 at the location of the smaller end, seen in the direction of said end.

For the sake of clarity, FIG. 1 only shows a cross-section of the shape of the profile on the upper surface of a track 2 at the point where the roll 1 rests. Similarly, for the sake of clarity, FIG. 3 shows only a cross-section of the profile shape of the upper surface of the track 2 at the point where the roll rests.

In FIGS. 1 and 2, the roll 1 to be rotated is located on top of the track 2. The track 2 is moving when the rollers 3*a* and 3*b* are rotated. When the track moves, the roll 1 rotates in a trough 4 formed by the track. Even tough the roll 1 is nominally a cylinder, it actually has the shape of a cone. The larger end is marked with the reference numeral 5 and the smaller end with the reference numeral 6. Because the roll 1 consists of one piece, the rotational angles of the ends 5 and 6 are equal in size during the rotation, and since the diameter of end 5 is larger than the diameter of the end 6, the peripheral speed of the perimeter of the end 5 is higher than the peripheral speed of the end 6. The propagation speed of the track 2 is, however, the same at both ends. Therefore both ends 5 and 6 cannot follow the track 2 in accordance with the travel direction of the track 2. The peripheral speed of the larger end 5 is higher than the speed of the track 2, and thus, the end 5 moves against the travel direction of the track. The speed of the smaller end 6 is not sufficient, and the track 2 carries it along. Therefore, the longitudinal axis of the roll 1 swings in the trough 4, and the roll 1 is set in a diagonal position in the trough 4 at such a point that the slipping of the roll 1 finally prevents it from swinging further.

With reference to FIG. 1, the longitudinal axis of the conical roll 1 is marked with a straight line X which at the same time conjoins the central line of the roll 1. It can be seen that when the roll 1 is positioned on the track 2, the central line X is positioned in a diagonal position with respect to the surface of the track 2 supporting the roll 1. With reference to FIG. 2, the rollers 3*a* and 3*b* are rotated clockwise, wherein the upper surface of the continuous track 2 moves substantially to the right at the same time causing the rotation of the roll 1 counterclockwise. Because of the differences in speed, when the roll 1 rotates, the end 6 tends to follow the track to the right, and the end 5 tends to move to the left. Thus, the central line X also tends to turn. Correspondingly, when the rollers 3*a* and 3*b* are rotated counterclockwise, the directions of motion of the track 2 and the roll 1 are opposite to the directions marked in FIG. 2.

In the rotation of rollers 3*a* and 3*b*, it is possible to apply devices, such as motors known per se, which can be applied in a manner known as such by anyone skilled in the art. The rollers 3*a* and 3*b* and their tracks 2 can be arranged in a supporting frame known as such, which can also comprise actuator means known per se, such as a pressurized medium operated cylinder for tilting the track 2 to transfer and receive the roll 1.

FIGS. 3 and 4 show an embodiment according to the invention in which the prior art swinging of the roll 1 is eliminated. The roll 1 to be rotated, the track 2 and the rollers 3*a* and 3*b* are similar to those shown in FIGS. 1 and 2. The profile of the track 2 in the direction of the longitudinal axis of the roll 1 is, however, changed by means of diagonal surfaces 7*a* and 7*b* located at the edges of the track 2, which surfaces can be formed of wedge parts attached on the surface of the track 2. The surfaces 7*a* and 7*b* function in a manner described hereinbelow. When the track 2 starts to move, and the roll 1 starts to rotate, it swings in a similar manner as described in connection with FIGS. 1 and 2. Because of the swinging, the roll 1 also moves in the direction of its longitudinal axis X, wherein the smaller end 6 climbs on top of the surface 7*b*. The roll 1 climbs o far on top of the surface 7*b* that the longitudinal axis X of the roll 1 is parallel to the trough 4 again, and the swinging is eliminated. Thereafter, the roll 1 rotates in such a manner that its longitudinal axis X is parallel to the trough 4, wherein the necessary work stages, such as the wrapping of the roll into a packing film during the rotation, proceed without problems with a good output.

With reference to FIG. 4, the rollers 3*a* and 3*b* are rotated clockwise, wherein the upper surface of the continuous track 2 moves substantially to the right, at the same time causing the rotation of the roll 1 counterclockwise. Correspondingly, when the rollers 3*a* and 3*b* are rotated counterclockwise, the directions of motion of the track 2 and roll 1 are opposite to the directions marked in FIG. 2. In different situations, the roll 1, however, moves in the direction of its longitudinal axis X and climbs on the surface 7*b*, which is on the side of the smaller end 6. Thus, the central line X conjoins the axis of rotation of the roll 1, and the swinging is prevented. The method functions in a corresponding manner in a situation where the end 5 has a larger diameter than the end 6. A corresponding situation occurs when the roll 1 is positioned in such a way in the situation of FIG. 3 that the end 6 is closer to the surface 7*a* on the right side. Thus, when the roll 1 is rotated, it climbs on the surface 7*a*. It is obvious that if the roll 1 is always positioned in such a way on the track that the smaller end 6 is on the left, only the surface 7*b* is necessary. However, the tapering direction of the rolls 1 always varies as a result of the presented problems, and thus the track 2 is advantageously provided with both surfaces 7*a* and 7*b* for manipulation of different rolls 1.

The shape of the side line of the roll 1, i.e., the nominal profile of the mantle 1*a* does not have to be straight. Thus, the general shape of the rotating profile i.e. the shape of the supporting surface 2*a* of the track 2 in the longitudinal direction X of the roll, corresponds to the nominal profile of the roll 1, but deviates from the same in a manner described hereinbelow. When the actual profile of the roll 1 deviates from the nominal profile, the roll 1 is transferred in the direction of its longitudinal axis X. The rotating profile is selected in such a manner that in this transferred position, the axis of rotation of the roll 1 is again positioned in the direction of the longitudinal axis X of the roll 1, wherein the swinging ceases.

In the embodiment of FIG. 3, the profile of the surface of the track 2 guiding and supporting the rotating piece 1 is straight in its central section, and both of its ends are provided with a diagonal surface 7*a* and 7*b* which rises outwards. Thus, the nominal shape of the piece 1 is a cylinder. According to a preferred embodiment of the invention the guiding and supporting surface 2 is a chain conveyor. According to another preferred embodiment, the invention is applied in a device in which the roll 1 is wrapped in a package during the rotation. When the cylindrical straight roll is positioned on the track 2 partly on top of the surface 7*a* or 7*b*, it moves in the direction of its longitudinal axis when rotated and is centered into a new position on top of the section 2*a*. Thus, according to the invention, the longitudinal axis of the roll is positioned in parallel with the trough 4 and the swinging is eliminated, and thus, the invention is also suitable for manipulation of other rolls.

The invention is not restricted solely to the above-presented preferred embodiment of the invention, but it can vary within the scope of the presented claims. In addition to the presented wrapping devices, the invention is suitable for other devices and methods in processing of rolls, in which they have to be rotated around their longitudinal axis, as was stated hereinabove. The invention can be applied in connection with the present trough-like rotating devices by providing them with diagonal surfaces, as was presented above.

What is claimed is:

1. Method for rotating a rotational body around its longitudinal axis, by means of motion of a hanging surface forming a transversal trough for guiding and supporting said body, comprising:

allowing said body to climb on a surface part having an increased slope by guiding the longitudinal axis to a new position by means of a transversal profile of the hanging surface to eliminate swinging of the body, wherein the body is moving on said hanging surface in a direction of said longitudinal axis due to the swinging of said body.

2. A method according to claim 1, wherein the transversal profile comprises a straight section and a diagonal surface that rises outwards from said straight section.

3. A method according to claim 2, wherein the body has a conical shape including a smaller end and a larger end, wherein said smaller end has a diameter that is smaller than a diameter of the larger end, wherein during rotation, the smaller end is moving in the direction of the longitudinal axis, and wherein the smaller end is guided on the diagonal surface.

4. A method according to claim 1, wherein the longitudinal axis is guided in parallel with the transversal trough.

5. A method according to claim 2, wherein the longitudinal axis is guided in parallel with the trough.

6. A method according to claim 1, wherein the longitudinal axis is guided to a new diagonal position with respect to said hanging surface.

7. Device for rotating a rotational body around its longitudinal axis, comprising:

a hanging surface that moves to rotate said body, said hanging surface forming a transversal trough for guiding and supporting said body, wherein said body is moving on the hanging surface in a direction of said longitudinal axis due to swinging of said body, and wherein said hanging surface comprises a transversal profile shaped to guide the longitudinal axis to a new diagonal position with respect to said hanging surface to eliminate the swinging of said body.

8. A device according to claim 7, wherein said transversal profile comprises a straight section and a diagonal surface which is arranged at least on one side of the straight section and which rises upwards from the straight section.

9. A device according to claim 7, wherein said hanging surface is a slat conveyor which hangs between rollers.

10. A device according to claim 8, wherein said hanging surface is a slat conveyor which hangs between rollers.

11. Arrangement for a rotating device for rotating a rotational body around its longitudinal axis, comprising:

a hanging surface that moves to rotate said body, said hanging surface forming a transversal trough for guiding and supporting said body, wherein said body is moving on the hanging surface in a direction of said longitudinal axis due to swinging of said body, and wherein the arrangement comprises a profile part to be arranged transversally on said hanging surface to guide the longitudinal axis into a new position to eliminate the swinging of the body.

12. An arrangement according to claim 11, wherein said profile part has a wedge shape.

13. An arrangement according to claim 11, wherein said profile part is arranged to form a diagonal surface portion which rises outwards from at least one end of a straight surface portion of a transversal profile of said hanging surface.

14. An arrangement according to claim 12, wherein said profile part is arranged to form a diagonal surface portion which rises outwards from at least one end of a straight surface portion of a transversal profile of said hanging surface.

* * * * *